US010233695B2

(12) United States Patent
Guan et al.

(10) Patent No.: US 10,233,695 B2
(45) Date of Patent: Mar. 19, 2019

(54) WEIGHT-ON-BIT SELF-ADJUSTING DRILL BIT

(71) Applicant: CHINA UNIVERSITY OF PETROLEUM (EAST CHINA), Qingdao (CN)

(72) Inventors: Zhichuan Guan, Qingdao (CN); Yongwang Liu, Qingdao (CN); Huaigang Hu, Qingdao (CN); Ben Guan, Qingdao (CN); Yucai Shi, Qingdao (CN); Hualin Liao, Qingdao (CN)

(73) Assignee: CHINA UNIVERSITY OF PETROLEUM (EAST CHINA), Shandong (CN)

( * ) Notice: Subject to any disclaimer, the term of this patent is extended or adjusted under 35 U.S.C. 154(b) by 0 days.

(21) Appl. No.: 16/060,920

(22) PCT Filed: Sep. 11, 2017

(86) PCT No.: PCT/CN2017/101196
§ 371 (c)(1),
(2) Date: Jun. 8, 2018

(87) PCT Pub. No.: WO2018/036567
PCT Pub. Date: Mar. 1, 2018

(65) Prior Publication Data

US 2018/0363381 A1 Dec. 20, 2018

(30) Foreign Application Priority Data

Jan. 20, 2017 (CN) ..... 2017 1 0041423

(51) Int. Cl.
*E21B 10/60* (2006.01)
*E21B 10/28* (2006.01)
(Continued)

(52) U.S. Cl.
CPC ..... *E21B 10/28* (2013.01); *E21B 10/38* (2013.01); *E21B 10/602* (2013.01); *E21B 10/62* (2013.01)

(58) Field of Classification Search
CPC ..... E21B 10/28
(Continued)

(56) References Cited

U.S. PATENT DOCUMENTS

2004/0238221 A1 12/2004 Runia et al. ..... 175/61

FOREIGN PATENT DOCUMENTS

CN 1067092 A 12/1992
CN 103628819 A 3/2014
(Continued)

OTHER PUBLICATIONS

The International Search Report of corresponding International PCT Application No. PCT/CN2017/101196, dated Dec. 15, 2017.

*Primary Examiner* — Taras P Bemko
(74) *Attorney, Agent, or Firm* — J.C. Patents

(57) ABSTRACT

A weight-on-bit self-adjusting drill bit includes a reaming bit, a WOB adjusting element, a transmission mechanism and a pilot bit and a pulsating impact generating mechanism; the pulsating impact generating mechanism includes a centralizing element, a driving element, a rotating element and a throttling element which are placed and connected successively, the centralizing element, the driving element and the rotating element are connected successively, the throttling element is in clearance fit with the rotating element, both of the centralizing element and the throttling element are respectively provided with a flow-through passage for the drilling fluid to flow through, the driving element drives the rotating element to rotate, the rotating element rotates relative to the flow-through passage on the throttling element.

16 Claims, 6 Drawing Sheets

(51) Int. Cl.
*E21B 10/38* (2006.01)
*E21B 10/62* (2006.01)

(58) Field of Classification Search
USPC ..... 175/385
See application file for complete search history.

(56) References Cited

FOREIGN PATENT DOCUMENTS

| | | | |
|---|---|---|---|
| CN | 10483210 | A | 8/2015 |
| CN | 204627429 | U | 9/2015 |
| CN | 105317377 | A | 2/2016 |
| CN | 105443041 | A | 3/2016 |
| CN | 106703701 | A | 5/2017 |

WEIGHT-ON-BIT SELF-ADJUSTING DRILL BIT

CROSS-REFERENCE TO RELATED APPLICATION

This application is a national phase application of international application No. PCT/CN2017/101196 filed on Sep. 11, 2017, which in turn claims the priority benefits of Chinese application No. 201710041423.1, filed on Jan. 20, 2017. The contents of these prior applications are hereby incorporated by reference in their entirety.

TECHNICAL FIELD

The present application belongs to the technical field of petroleum engineering and relates to a drilling tool, specifically to a weight-on-bit self-adjusting drill bit (WSADB).

BACKGROUND

With the development of oil and gas exploration towards deeper and harder strata, the requirement for drilling is also getting higher and higher, and more and more attention has been paid to increasing the rate of penetration (ROP). It is the most effective method to increase ROP by releasing rock stress in advance which changes a stress field of a drilled stratum. At present, domestic and foreign experts and scholars implement this method in two ways. The first way is to release the stratum stress based on hydraulic energy of a drilling fluid, which is represented by a high-pressure pulsed jet, a cavitation pulsed jet, an abrasive pulsed jet and the like. The way of releasing the stratum stress based on the hydraulic energy requires an addition of a special tool mounted above the drill bit, which, to a certain extent, increases consumption of drilling fluid energy. At the same time, it also needs to take into account the safety and reliability of the special tools mounted. The second way is to change stress field during rock breaking by changing a contact shape between the drill bit and the bottom hole, which is represented by Kymera combined bit and a reaming while drilling bit. By the way of changing the contact shape between the drill bit and the bottom hole which releases the stress of the drilled formation, the purpose of reducing the stress of the formation at the bottom hole can be achieved just by optimizing design of the drill bit, and it has a broad development prospect. However, during the process of drilling into interlayers by the Kymera combined bit and the reaming while drilling bit, a pilot bit is prone to collapse or increased wear and so on due to their inability to automatically adjust the distribution of the weight on bit (WOB), resulting in reduced service life, and therefore the best speed-increasing effect of such drill bit cannot been achieved.

Chinese invention patent with publication No. CN105443041A discloses a weight-on-bit self-adjusting drill bit, and specifically discloses the following features: the weight-on-bit self-adjusting drill bit comprises a joint, a fluid-passage and force-transmission short connector, a reaming bit, a force storage spring, and a pilot bit; the joint, the fluid-passage and force-transmission short connector and a pilot bit are connected into a whole through thread; the reaming bit is located between the joint and the pilot bit, and mounted outside the fluid-passage and force-transmission short connector; an axial relative movement between the reaming bit and the whole can be realized, where said whole is comprised of the reaming bit and the joint, the fluid-passage and force-transmission short connecter and the pilot bit; the force storage spring is mounted in the middle of the fluid-passage and force-transmission short connector, which configured to reserve elastic force and to recover relative position between the reaming bit and the whole. The invention has the advantages of simple principle and structure, and wide application range, and can be configured to ensure fast drilling with small WOB when performing deviation-controlled straight drilling and improve the drilling efficiency of vertical wells in an easily inclined formation. The drilling process is completely the same as conventional drilling, which is conducive to popularization and use.

Chinese invention patent with publication No. CN105317377A discloses a central weight-on-bit self-adjusting drill bit, and specifically discloses the following features: the central weight-on-bit self-adjusting drill bit comprises a reaming bit, a weight adjusting spring, a shunting and force-transmission assembly and a pilot bit; the pilot bit and the shunting and force-transmission assembly are connected into one body which is mounted in an axial torque transmission hole of the reaming bit, where the pilot bit protrudes out of a crown of the reaming bit; the weight adjusting spring is arranged between a top of the shunting and force-transmission assembly and a lower end of a joint of the reaming bit; the reaming bit can be disposed into one or more stages. The invention has the advantages of simple principle and structure, wide application scope, and it can be applied to all kinds of stratum with better using effect in the interbedded stratum; it can be used with the pulse jet generator to further improve the ROP; in the course of drilling, the operation is identical to that of conventional drilling, and there is no special requirement for ground facilities, a drilling string, a bit type, which is advantageous to the drill bit popularization and the filed application.

The weight-on-bit self-adjusting drill bit disclosed in the above two patent applications use the pilot bit which bears partial WOB to break the stratum and drill a small diameter wellbore in advance, and the reaming bit, which bears another part of the WOB, to ream the drilled small-diameter wellbore. By using the spring between the pilot bit and the reaming bit, the WOB distribution on the pilot bit and the reaming bit is adjusted to be good, and the relative ROP between them is controlled to be reasonable, thereby improving the ROP. An indoor test verifies that the ROP can be improved by this kind of drill bit, especially in the multi-interlayer stratum. However, the effect of this kind of drill bit has not yet achieved the best, and the ROP is expected to increase further if other speed-increasing schemes can be implemented on such drill bit.

SUMMARY

A purpose of the present invention is to aim at the above defects in the prior art and provide a weight-on-bit self-adjusting drill bit (WSADB), namely a pulsed jet type weight-on-bit self-adjusting drill bit, the drill bit realizes integral pulsed jet modulation while a pilot bit is rotating and drilling, thereby reducing chip hold down effect of the pilot bit and a reaming bit, further achieving a purpose of protecting the drill bit and improving service life and ROP of the drill bit and further improving an drilling effect.

In order to achieve the above purposes, the present application provides a WSADB, namely a pulsed jet type weight-on-bit self-adjusting drill bit, comprising a reaming bit, a weight-on-bit (WOB) adjusting element, a transmission mechanism and a pilot bit, the reaming bit comprises a joint and a reaming bit crown connected to the joint, the pilot bit is mounted inside the reaming bit crown and protrudes out of the reaming bit crown, a pulsating impact generating mechanism is provided inside the joint for modulating a drilling fluid to form a pulsed jet at a reaming bit nozzle and a pilot bit nozzle respectively and generating a periodic axial downward impulsive force which periodically impacts on the pilot bit during the modulation of the drilling fluid, the pulsating impact generating mechanism, the WOB adjusting element, the transmission mechanism, and the pilot bit are connected successively; the pulsating impact generating mechanism comprises a centralizing element, a driving element, a rotating element and a throttling element which are placed successively, the centralizing element, the driving element and the rotating element are connected successively, the throttling element is in clearance fit with the rotating element, both of the centralizing element and the throttling element are respectively provided with a flow-through passage for the drilling fluid to flow through, the driving element drives the rotating element to rotate, the rotating element rotates relative to the flow-through passage on the throttling element; when the rotating element covers the flow-through passage on the throttling element, an amount of the drilling fluid through the flow-through passage on the throttling element is reduced, when the rotating element does not cover the flow-through passage on the throttling element, the amount of the drilling fluid through the flow-through passage on the throttling element is increased.

Preferably, the throttling element, the WOB adjusting element and a shunting element of the transmission mechanism are placed in an inner cavity formed by connection of the joint and the reaming bit crown, the throttling element is in contact with the WOB adjusting element.

Preferably, the driving element is a spiral rotor, the rotating element is an impeller, a part where the spiral rotor is connected to the impeller is a spline type structure, and the spline type structure cooperates with a key groove of the impeller so that the impeller is rotated synchronously with the spiral rotor.

Preferably, two ends of the spiral rotor are centralizing shafts, a middle of the spiral rotor is a spiral steel shaft of single head or multi-head; a first centralizing shaft is mounted in a middle hole of the centralizing element and protrudes out of the centralizing element; a part of a second centralizing shaft is the spline type structure and cooperates with the key groove of the impeller, another part of the second centralizing shaft is a connecting shaft mounted in the throttling element and protrudes out of the throttling element.

Further, a first anti-erosion cap is mounted at a part where the first centralizing shaft protrudes out of the centralizing element, and a second anti-erosion cap is mounted at a part where the second centralizing shaft protrudes out of the throttling element.

Preferably, the impeller comprises impeller blades, an impeller center hole for passing through the second centralizing shaft is provided in a center of the impeller blades, a side wall of the impeller center hole is provided with the key groove of the impeller for transmitting torque in cooperation with the spline type structure of the second centralizing shaft.

Preferably, the impeller blades are uniformly distributed in a circumferential direction, a number of the impeller blades and a number of flow-through passages on the throttling element can be adjusted according to drilling engineering requirements.

Preferably, the throttling element is a throttling disk, the flow-through passage is an intermittent flow-through hole of the throttling disk, and a plurality of intermittent flow-through holes are uniformly distributed in a plane space of the throttling disk; a locking gear of the throttling disk is disposed on an outer side of the throttling disk, the locking gear of the throttling disk is placed in a locking groove provided in the inner cavity formed by the connection of the joint and the reaming bit crown, and the locking gear moves in the locking groove; a throttling disk center hole is provided in a center of the throttling disk, the connecting shaft of the second centralizing shaft is mounted in the throttling disk center hole, and the throttling disk center hole and the second centralizing shaft cooperate with each other in size.

Compared with the prior art, the present application has the following beneficial effects:

(1) The pulsating impact generating mechanism of the present application has a throttling effect so that continuous flow of the drilling fluid in a water hole of the drill bit is converted into an intermittent and variable flow into the nozzles, reducing chip hold down effect at a bottom hole, and by modulating the pulsed jet, the WOB acts on the pilot bit in a fluctuant impact manner to achieve automatic and reasonable distribution of the WOB and to improve rock breaking efficiency of the pilot bit, thereby achieving the purpose of improving overall rock breaking effect of the drill bit.

(2) The rotating element of the pulsating impact generating mechanism of the present application employs the spiral rotor, by adjusting head number of the spiral rotor, it is possible to generate a variable-frequency axial pulsating impact on the drill bit without an additional axial impactor, thereby reducing possibility of an downhole accident while improving rock breaking energy of the drill bit.

(3) The WSADB of the present application, namely the pulsed jet type weight-on-bit self-adjusting drill bit, is provided with the pulsating impact generating mechanism therein, so as to form a pulsed jet at the nozzles of the drill bit and apply a periodic impact on the pilot bit, thereby realizing automatic and reasonable distribution of the WOB, reducing the chip hold down effect of the drill bit, and increasing the ROP.

(4) The WSADB of the present application, namely the pulsed jet type weight-on-bit self-adjusting drill bit, can be applied to all kinds of strata, and has higher adaptability in an interlayer stratum, meanwhile, because of the role thereof in adjusting the WOB, the force on the drill bit is more reasonable, thereby further protecting the drill bit and improving the service life of the drill bit.

(5) The WSADB of the present application, namely the pulsed jet type weight-on-bit self-adjusting drill bit, has simple principle and structure and does not need to mount other tools when the pilot bit is rotating and drilling and changing the force field in the stratum, without affecting the implementation of other drilling processes.

(6) The WSADB of the present application, namely the pulsed jet type weight-on-bit self-adjusting drill bit, has wide range of applications and can be used in various well types such as a straight well, a directional well and a horizontal well and so on, and can be directly cooperatively used with a power drilling tool or other tools.

(7) Because the WSADB of the present application, namely the pulsed jet type weight-on-bit self-adjusting drill bit, adopts a multi-stage structure, the contact area between the drill bit and the bottom hole is increased during the drilling process, which makes stability of direction controlling better, and is very suitable for directional drilling;

meanwhile, the multi-stage structure makes a well wall more regular during the drilling process, thereby improving the quality of the wellbore.

(8) The WSADB of the present application, namely the pulsed jet type weight-on-bit self-adjusting drill bit, during use, the operation construction thereof is exactly the same as that of a conventional drill bit, there are no special requirements for ground facilities, a drilling string, a downhole power drilling tool, which are conducive to popularization and use.

Figure 1:
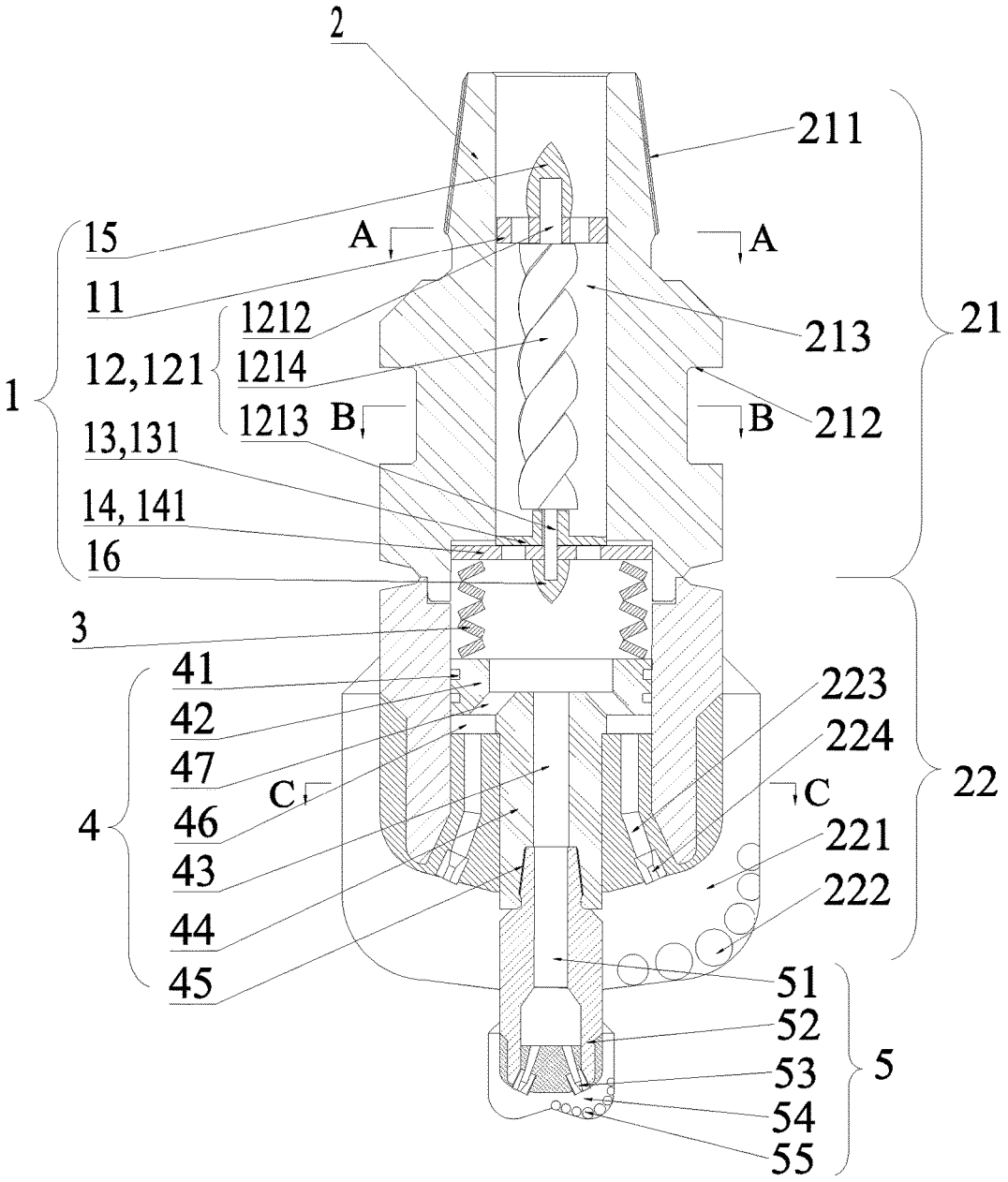
FIG. 1 is a schematic structural diagram of a pulsed jet type weight-on-bit self-adjusting drill bit of the present application.

In which:

1: pulsating impact generating mechanism; 11: centralizing element; 111: flow-through passage; 112: middle hole; 12: driving element; 121: spiral rotor; 1211: spline type structure; 1212: first centralizing shaft; 1213: second centralizing shaft; 1214: spiral steel shaft; 1215: connecting shaft; 13: rotating element; 131: impeller; 1311: impeller blade; 1312: impeller center hole; 1313: key groove of impeller; 14: throttling element; 141: throttling disk; 1411: intermittent flow-through hole of throttling disk; 1412: throttling disk center hole; 1413: locking gear of throttling disk; 15: first anti-erosion cap; 16: second anti-erosion cap; 2: reaming bit; 21: joint; 211: joint thread; 212: shackle groove; 213: first drilling fluid flow passage; 22: reaming bit crown; 221: reaming bit knife wing; 222: reaming bit cutting teeth; 223: nozzle flow passage of reaming bit; 224: reaming bit nozzle; 3: WOB adjusting element; 4: transmission mechanism; 401: centralizing seal surface; 402: limit surface of shunting element; 403: torque transmission surface; 404: seal groove; 41: sliding seal element; 42: shunting element; 43: second drilling fluid flow passage; 44: transmission short shaft; 45: connecting buckle for pilot bit; 46: rectifying cavity; 47: drilling fluid flow-through hole of reaming bit; 5: pilot bit; 51: third drilling fluid flow passage; 52: pilot bit crown; 53: pilot bit nozzle; 54: pilot bit knife wing; 55: pilot bit cutting teeth.

DETAILED DESCRIPTION

Hereinafter, the present application will be specifically described by way of exemplary embodiments. However, it should be understood that an element, a structure, and a feature in one embodiment may be advantageously combined into other embodiments without further recitation.

In the description of the present application, it should be noted that a longitudinal direction of a pulsed jet type weight-on-bit self-adjusting drill bit is a vertical direction after installation; terms "inner", "outer", "upper", "middle", "lower" and the like indicate the positional or positional relationship based on the positional relationship shown in the drawings, and are merely for easily describing the present application and for simplifying the description, rather indicating or implying that a device or an element shall have a particular orientation, be constructed and operated in a particular orientation, and therefore should not be construed as a limitation of the present application. In addition, terms "first", "second", and the like are used for descriptive purposes only and are not to be construed as indicating or implying relative importance.

As shown in FIG. 1, a pulsating impact generating mechanism 1 provided by the present application comprises a centralizing element 11, a driving element 12, a rotating element 13, and a throttling element 14 which are placed successively, the centralizing element 11, the driving element 12 and the rotating element 13 are connected successively, one end of the driving element 12 is disposed on the centralizing element 11, and another end of the driving element 12 is disposed on the rotating element 13 so that the driving element 12 is disposed in an axial direction, the throttling element 14 is in clearance fit with the rotating element 13 so that the rotating element 13 rotates relative to the throttling element 14, both of the centralizing element 11 and the throttling element 14 are respectively provided with a flow-through passage for drilling fluid to flow through, the driving element 12 drives the rotating element 13 to rotate, the rotating element 13 rotates relative to the flow-through passage on the throttling element.

The driving element 12 drives the rotating element 13 to rotate, when the rotating element 13 covers the flow-through passage on the throttling element 14, an amount of the drilling fluid through the flow-through passage on the throttling element 14 is reduced, when the rotating element 13 does not cover the flow-through passage on the throttling element 14, the amount of the drilling fluid through the flow-through passage on the throttling element 14 is increased.

The aforementioned pulsating impact generating mechanism 1 realizes periodical change of the amount of the drilling fluid through the flow-through passage on the throttling element 14 by cooperation between the rotating element 13 and the throttling element 14, thereby forming a pulsed jet.

When the pulsating impact generating mechanism 1 is applied in a drill bit used in a drilling process, on the one hand, the pulsed jet may be formed at nozzles of the drill bit and reduce chip hold down effect of the drill bit, thereby protecting the drill bit and increasing ROP, on the other hand, by modulating the amount of the drilling fluid in the pulsating impact generating mechanism 1, when the rotating element 13 covers the flow-through passage on the throttling element 14, since the passage through which the drilling fluid flows is blocked, the drilling fluid exerts an overall axial downward impact on the pulsating impact generating mechanism 1, and can further generate weight impact on a member disposed below the pulsating impact generating mechanism 1.

Figure 2:
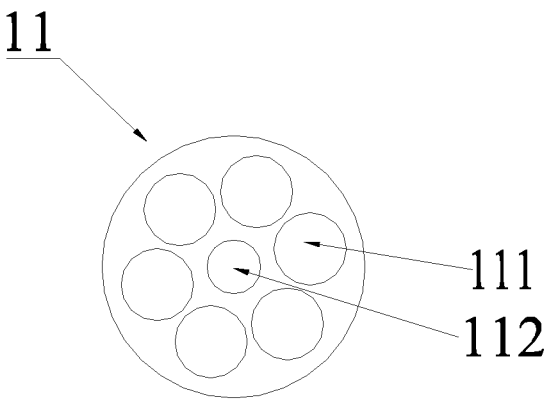
FIG. 2 is a schematic structural diagram of a centralizing element of the present application.

Referring to FIG. 2, as a preferred embodiment, a plurality of flow-through passages 111 are uniformly distributed on the centralizing element 11, the drilling fluid enters the pulsating impact generating mechanism 1 through the flow-through passages 111, a middle hole 112 for being passed through by the one end of the driving element 12 is provided in a middle of the centralizing element 11.

Figure 3:
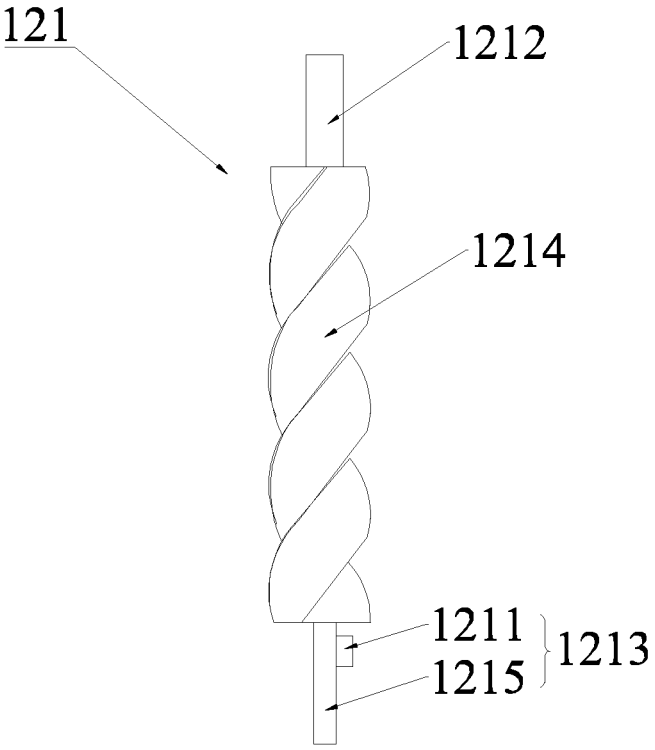
FIG. 3 is a schematic structural diagram of a spiral rotor of the present application.
Figure 4:
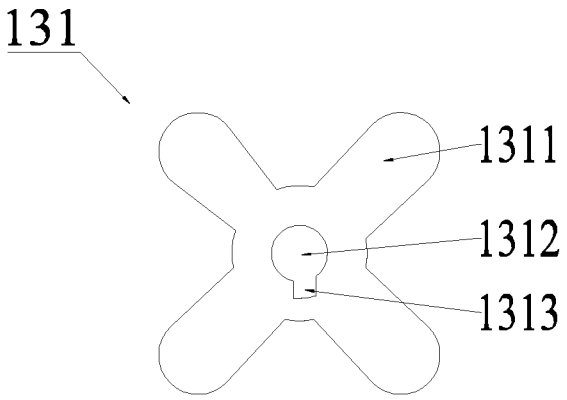
FIG. 4 is a schematic structural diagram of an impeller of the present application.

Referring to FIG. 1, in order to implement the modulation of the drilling fluid by the pulsating impact generating mechanism 1, as a preferred embodiment, the driving element 12 is a spiral rotor 121 (as shown in FIG. 3), the rotating element 13 is an impeller 131 (as shown in FIG. 4), a part where the spiral rotor 121 is connected to the impeller 131 is a spline type structure 1211, a key groove 1313 of the impeller is disposed at the position where the impeller 131 and the spline type structure 1211 cooperate with each other, the spline type structure 1211 cooperates with the key groove 1313 of the impeller so that the impeller 131 can be rotated synchronously with the spiral rotor 121. The throttling element 14 is a throttling disk 141 (shown in FIG. 5), one surface of the throttling disk 141 is in clearance fit with the impeller 131.

Further referring to FIG. 1 and FIG. 3, as a preferred embodiment, two ends of the spiral rotor 121 are centralizing shafts, which are a first centralizing shaft 1212 at an upper end and a second central shaft 1213 at a lower end, respectively, a middle thereof is a single-headed or multi-headed spiral steel shaft 1214, the first central shaft 1212 is mounted in a middle hole 112 of the centralizing element 11 and protrudes out of the centralizing element 11, a part of the second centralizing shaft 1213 is the spline type structure 1211, and another part thereof is a connecting shaft 1215, the spline type structure 1211 cooperates with the key groove 1313 of the impeller to rotate the impeller 131 synchronously with the spiral rotor 121, the connecting shaft 1215 is mounted in the throttle element 14 and protrudes out of the throttle element 14. The connecting shaft 1215 is preferably a round shaft.

In order to prevent the two ends of the spiral rotor from being damaged due to erosion by the drilling fluid, in another preferred embodiment, referring to FIG. 1, a first anti-erosion cap 15 is mounted at a part where the first centralizing shaft 1212 protrudes out of the centralizing element 11, a second anti-erosion cap 16 is mounted at a part where the second centralizing shaft 1213 protrudes out of the throttling element 14.

As a preferred embodiment, as shown in FIG. 4, the impeller 131 comprises impeller blades 1311, an impeller center hole 1312 for passing through the second centralizing shaft 1213 is provided in a center of the impeller blades 1311, the key groove 1313 of the impeller is provided on a side wall of the impeller center hole 1312, the key groove 1313 of the impeller cooperates with the spline structure 1211 of the second centralizing shaft 1213 to transmit torque, so that the impeller 131 is rotated synchronously with the spiral rotor 121.

Further, the impeller blades 1311 are uniformly distributed in a circumferential direction, the number of the impeller blades 1311 can be adjusted according to drilling engineering requirements.

Figure 5:
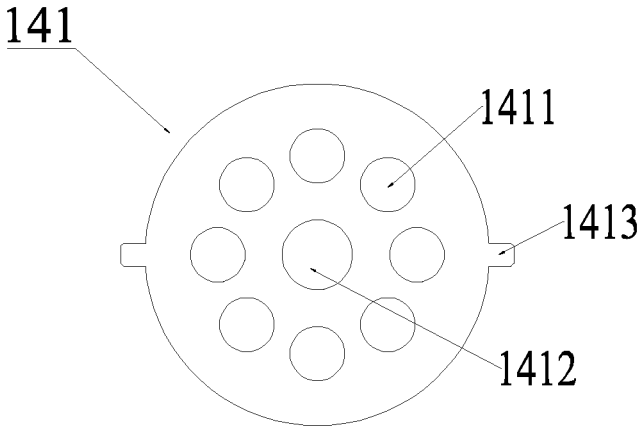
FIG. 5 is a schematic structural diagram of a throttling disk of the present application.
Figure 6:
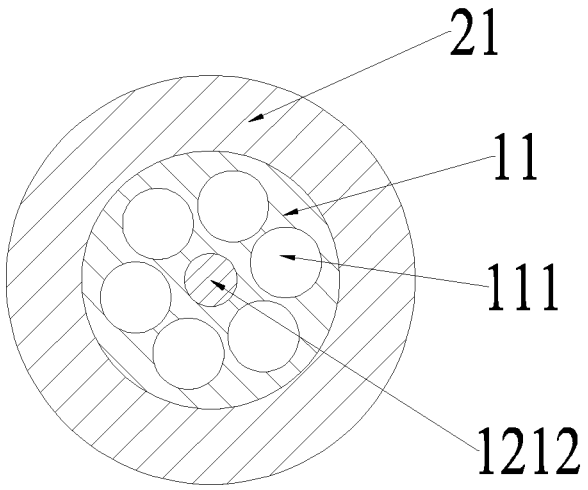
FIG. 6 is a cross-sectional diagram of a pulsed jet type weight-on-bit self-adjusting drill bit of the present application taken along Line A-A.

As a preferred embodiment, as shown in FIG. 5, intermittent flow-through holes 1411 of the throttling disk are uniformly distributed in a plane space of the throttling disk 141, similarly, the number of intermittent flow-through holes 1411 of the throttling disk can also be adjusted according to the drilling engineering requirement, the number of the intermittent flow-through holes 1411 of the throttling disk and the number of the impeller blades 1311 can be calculated according to the drilling engineering requirements. A throttling disk center hole 1412 is provided in center of the throttling disk 141, the throttling disk center hole 1412 and the second centralizing shaft 1213 cooperate with each other in size to allow the connecting shaft 1215 of the second centralizing shaft 1212 to pass through, so as to achieve the centralizing of the spiral rotor 121.

The spiral rotor 121 drives the impeller 131 to rotate, the impeller blade 1311 rotates relative to the intermittent flow-through holes 1411 of the throttling disk, when the impeller blade 1311 covers the intermittent flow-through hole 1411 of the throttling disk, the amount of the drilling fluid through the intermittent flow-through hole 1411 of the throttling disk is reduced, when impeller blade 1311 does not cover the intermittent flow-through hole 1411 of the throttling disk, the amount of the drilling fluid through the intermittent flow-through hole 1411 of the throttling disk is increased. Through the above process, the periodical change of the amount of the drilling fluid through the intermittent flow-through hole 1411 of the throttling disk is realized, and then the amount of the drilling fluid passing through is modulated to form the pulsed jet.

Referring to FIG. 1, a pulsed jet type weight-on-bit self-adjusting drill provided by the present application comprises a reaming bit 2, a weight-on-bit (WOB) adjusting element 3, a transmission mechanism 4, and a pilot bit 5, the reaming bit 2 comprises a joint 21 and a reaming bit crown 22 connected to the joint 21, the WOB adjusting element 3 and the transmission mechanism 4 are disposed in an inner cavity formed by connection of the joint 21 and the reaming bit crown 22, and the pilot bit 5 arranged at a bottom end of the transmission mechanism 4 is mounted inside the reaming bit crown 22 and protrudes out of the reaming bit crown 22, the transmission mechanism 4 is configured to transmit a torque of the reaming bit crown 22 to the pilot bit 5 to drive the pilot bit 5 to be rotated, the pulsating impact generating mechanism 1 is provided inside the joint 21, the pulsating impact generating mechanism 1, the WOB adjusting element 3, the transmission mechanism 4, and the pilot bit 5 are connected successively.

The WOB adjusting element 3 is disposed between the pulsating impact generating mechanism 1 and the transmission mechanism 4, the transmission mechanism 4 can reciprocate slightly in an axial direction within the reaming bit crown 22 under an action of the WOB adjusting element 3, so that the pilot bit 5 can be driven by the transmission mechanism 4 to reciprocate slightly in an axial direction relative to the reaming bit 2. When the pilot bit 5 breaks the rock and encounters a large resistance, the pilot bit 5 is subjected to an upward resistance, presses the WOB adjusting element 3 to be compressed and generate a larger elastic force, WOB on the pilot bit 5 is increased under an action of the elastic force of the WOB adjusting element 3, when the total WOB is constant, WOB on the reaming bit 2 is reduced, thereby realizing automatic and reasonable distribution of the WOB.

The pulsed jet type weight-on-bit self-adjusting drill bit utilizes a combination of the reaming bit 2 and the pilot bit 5 to perform the drilling so as to change contact manner between the drill bit and rock at a bottom hole to release stratum stress, thereby reducing specific energy for rock breaking; utilizes the WOB adjusting element 3 to realize the automatic and reasonable distribution of the WOB respectively on the reaming bit 2 and the pilot bit 5, utilizes the relative axial movement between the reaming bit 2 and the pilot bit 5 to realize automatic adjustment of the ROPs of the two bits, and thus automatically distributes and adjusts the WOB respectively on the reaming bit 2 and the pilot bit 5 to be optimum and controls the ROPs thereof to be the most reasonable; utilizes the modulation over the amount of the drilling fluid by the pulsating impact generating mechanism 1 to form the pulsed jet at the nozzles of the reaming bit 2 and the pilot bit 5, utilizes periodic axial downward impact generated during the modulation process of the amount of the drilling fluid to apply a periodic impact on the pilot bit 5, reduces the chip hold down effect of the reaming bit 2 and the pilot bit 5 by the pulsed jet while the pilot bit 5 is rotating and drilling, and realizes the automatic and reasonable distribution of the WOB, so as to achieve the purpose of protecting the drill bit and improving the service life and the ROP of the drill bit.

As a preferred embodiment, the pulsating impact generating mechanism 1 is configured to be able to reciprocate axially within the joint 21, the throttling disk 141 is in contact with the WOB adjusting element 3. When the impeller blade 1311 covers the intermittent flow-through hole 1411 of the throttling disk, as the passage through which the drilling fluid flows is blocked, the drilling fluid hydraulic force impels the impeller 131 and the throttling disk 141 to drive the pulsating impact generating mechanism 1 to move axially downward within the joint 21, so as to compress the WOB adjusting element 3 to generate an axially downward impact against the transmission mechanism 4 and the pilot bit 5; when the impeller blade 1311 does not cover the intermittent flow-through hole 1411, the drilling fluid can smoothly pass through the pulsating impact generating mechanism 1 and the axially downward impact disappears.

The above embodiment utilizes the periodic change of the amount of the drilling fluid in the pulsating impact generating mechanism 1 to generate periodical axial downward impact in the modulation process of the drilling fluid, thus further apply the periodical impact on the pilot bit 5, reduce the chip hold down effect of the reaming bit 2 and the pilot bit 5 while the pilot bit 5 is rotating and drilling, and further realize the automatic and reasonable distribution of the WOB respectively on the reaming bit 2 and the pilot bit 5, thereby achieving the purpose of protecting the drill bit and improving the service life and the ROP of the drill bit.

Further, referring to FIG. 5, a locking gear 1413 of the throttling disk is disposed on an outer side of the throttling disk 141, a locking groove is provided in the inner cavity formed by the connection of the joint 21 and the reaming bit crown 22, the locking gear 1413 of the throttling disk is placed in the locking groove and moves in the locking groove; the locking gear 1413 of the throttling disk cooperates with the locking groove to limit the rotation of the throttling disk 141 in a circumferential direction, but the throttling disk 141 can move up and down in the locking groove.

In a preferred embodiment, the WOB adjusting element 3 is a WOB adjusting spring, for example, a mechanical spring or a hydraulic spring, the automatic and reasonable distribution of the WOB on the reaming bit 2 and the pilot bit 5 is realized by the WOB adjusting spring.

Figure 7:
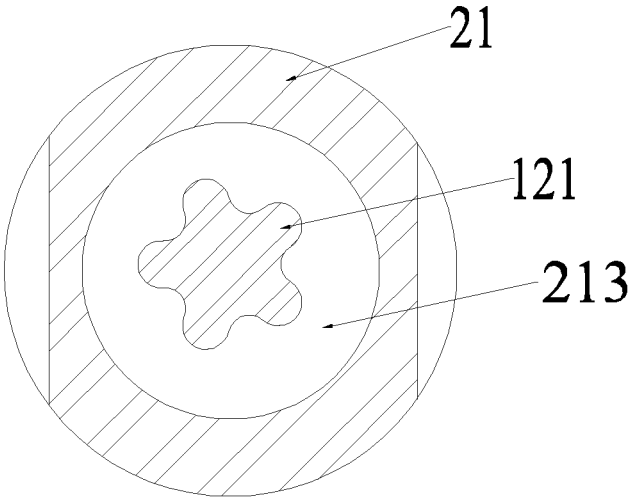
FIG. 7 is a cross-sectional diagram of a pulsed jet type weight-on-bit self-adjusting drill bit of the present invention taken along Line B-B.

Referring to FIG. 1, as a preferred embodiment, an upper part on an outer side of the joint 21 is provided with a joint thread 211 for connecting a combination of upper drill tools, a middle part thereof is provided with a shackle groove 212 for upward unloading the drill bit and providing the torque of the drill bit in a drilling process, a lower part thereof is provided with a connecting surface for connecting the joint 21 with the reaming bit crown 22. An inner side of the joint 21, from top to bottom, is: a first drilling fluid flow passage 213 for providing an flow-through space for the drilling fluid, a pressure-bearing step surface for limiting the throttle disk 141, a fixing cavity of the throttling disk 141 for fixing and limiting the throttling disk 141, and a spring outer protection cylinder for limiting a movement space of the WOB adjustment spring. As shown in FIG. 1 and FIG. 7, the spiral rotor 121 of the pulsating impact generating mechanism 1 is disposed within the first drilling fluid flow passage 213.

A top of the reaming bit crown 22 is a connecting surface of the reaming bit for connecting the reaming bit crown 22 with the joint 21, below the connecting surface of the reaming bit is the crown; the connecting surface of the reaming bit and the connecting surface of the lower part of the joint 21 are complementary to each other in size, to realize a connection between the reaming bit crown 22 and the joint 21.

Figure 8:
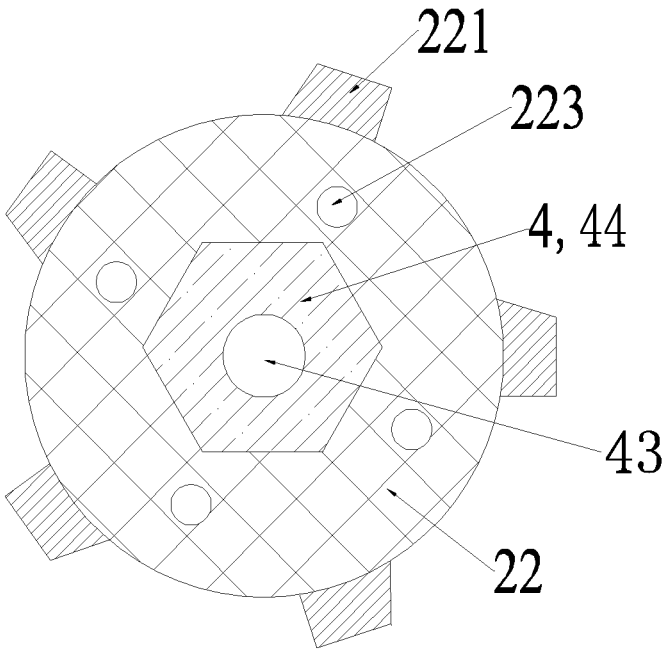
FIG. 8 is a cross-sectional diagram of a pulsed jet type weight-on-bit self-adjusting drill bit of the present invention taken along Line C-C.

An upper end inside the reaming bit crown 22 is a round hole, and a lower end thereof is an axial torque transmission hole, a diameter of the round hole is the same as a diameter of the spring outer protection cylinder of the joint 21, the axial torque transmission hole at the lower end of the reaming bit crown 22 penetrates a bottom of the reaming bit crown 22. As shown in FIG. 8, the cross-sectional shape of the axial torque transmission hole is a multi-side structure or a spline type structure, the multi-side structure or the spline type structure cooperates with the transmission mechanism 4 so that the transmission mechanism 4 is rotated synchronously with the reaming bit crown 22.

A plurality of reaming bit knife wings 221 are uniformly distributed on the outer side of the reaming bit crown 22, and number and shape of the reaming bit knife wings 221 vary with characteristic of a drilled stratum, reaming bit cutting teeth 222 are distributed on the reaming bit knife wing 221, and number and size vary with the characteristic of the drilled stratum; a nozzle flow passage 223 of the reaming bit is provided from the round hole at the upper end inside the reaming bit crown 22 to a root of the reaming bit knife wing 221 and the root is located at the bottom of the reaming bit crown 22, a reaming bit nozzle 224 is mounted at a bottom of the nozzle flow passage 223 of the reaming bit, the drilling fluid is jetted from the reaming bit nozzle 224 through the nozzle flow passage 223 of the reaming bit. Since characteristic of the reaming bit crown 22 is changed correspondingly with the geological characteristic and engineering requirements of the drilled stratum, the shapes, sizes, and numbers of the reaming bit knife wing 221, the reaming bit cutting teeth 222, the nozzle flow passage 223 and the reaming bit nozzle 224 provided on the reaming bit crown 22 are all changed with the change of the reaming bit crown 22.

Figure 9:
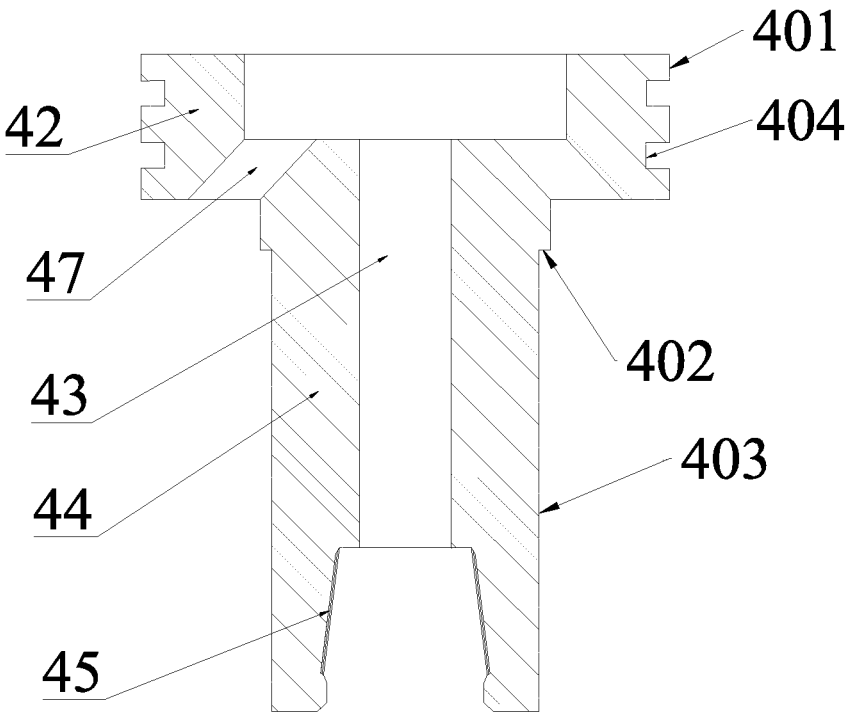
FIG. 9 is a schematic structural diagram of a transmission mechanism of the present application.

As shown in FIG. 9, an upper part on an outer side of the transmission mechanism 4 is a centralizing seal surface 401, and a middle part thereof is a limit surface 402 of the shunting element, and a lower part thereof is a torque transmission surface 403. The centralizing seal surface 401 cooperates with the round hole inside the reaming bit crown 22 to ensure that the transmission mechanism 4 do not radially shake relative to the reaming bit crown 22. A seal groove 404 is provided on the centralizing seal surface 401, a sliding seal element 41 is provided inside the seal groove 404. A diameter of the limit surface 402 of the shunting element is smaller than that of the centralizing seal surface 401 but larger than that of a circumscribed circle of the torque transmission surface 403, a step formed between the limit surface 402 of the shunting surface and the torque transmission surface 403 limits a relative axial displacement between the transmission mechanism 4 and the reaming bit crown 22 and prevents the transmission mechanism 4 from coming out of the reaming bit crown 22. The torque transmission surface 403 is in clearance fit with the axial torque transmission hole at the lower end of the reaming bit crown 22 for transmitting the torque of the reaming bit 2 to the transmission mechanism 4.

As shown in FIG. 1 and FIG. 9, an upper part of the transmission mechanism 4 is a shunting element 42, a middle thereof is a transmission short shaft 44 provided with a second drilling fluid flow passage 43, and a lower part thereof is a connecting buckle 45 of the pilot bit; the second drilling fluid flow passage 43 is configured to provide a flow passage for the drilling fluid diverted to the pilot bit 5, the connecting buckle 45 of the reaming bit of the transmission mechanism 4 is configured to connect the pilot bit 5. As shown in FIG. 8, the transmission short shaft 44 is disposed in the axial torque transmission hole of the reaming bit crown 22 and cooperates with the axial torque transmission hole to make the two rotate synchronously.

As shown in FIG. 1, the throttling element 14, the WOB adjusting element 3, and the shunting element 42 of the transmission mechanism 4 are placed in the inner cavity formed by the connection of the joint 21 and the reaming bit crown 22, the throttling element 14 is in contact with one end of the WOB adjusting element 3, the shunting element 42 is in contact with another end of the WOB adjusting element 3.

Further, a rectifying cavity 46 for containing the drilling fluid is provided between a lower end of the shunting element 42 and the reaming bit crown 22, a bottom of the rectifying cavity 46 is the nozzle flow passage 223 of the reaming bit, the drilling fluid flows from the rectifying cavity 46 into the nozzle flow passage 223 of the reaming bit; drilling fluid flow-through hole 47 of the reaming bit for transmitting a part of the drilling fluid to the rectifying cavity 46 is provided in the shunting element 42 and above the rectifying cavity 46.

The drilling fluid entering the first drilling fluid flow passage 213 is divided into two parts by the shunting element 42, one part enters the second drilling fluid flow passage 43 of the transmission mechanism 4, and then enters the pilot bit 5, another part enters the rectifying cavity 46 via the drilling fluid flow-through hole 47 of the reaming bit and further enters the nozzle flow passage 223 of the reaming bit.

Referring to FIG. 1, further, a third drilling fluid flow passage 51 is provided inside the pilot bit 5, an upper part of an outer side thereof is a connecting thread of the pilot bit, and a lower part of the outer side thereof is a pilot bit crown 52; the connecting thread of the pilot bit is configured to connect the pilot bit 5 and the transmission mechanism 4 so that the pilot bit 5 can be rotated by the drive of the transmission mechanism 4; the pilot bit crown 52 is provided with a pilot bit nozzle 53, a pilot bit knife wing 54, and pilot bit cutting teeth 55; the positional relationship among the pilot bit nozzle 53, the pilot bit knife wing 54, and the pilot bit cutting teeth 55 are the same as the positional relationship among the reaming bit nozzle 224, the reaming bit knife wing 221 and the reaming bit cutting teeth 222 provided on the crown 22 of the reaming bit. Numbers and shapes of the pilot bit nozzle 53, the reaming bit knife wing 54 and the reaming bit cutting teeth 55 are changed with characteristic of the drilled stratum.

A process of forming pulsed jets at nozzles of the drill bit is as follows: referring to FIG. 1, the pulsating impact generating mechanism 1 is disposed in the first drilling fluid flow passage 213, the drilling fluid successively from top to bottom passes through the first drilling fluid passage 213, the intermittent flow-through holes 1411 of the throttling disk 141, and the shunting element 42 of the transmission mechanism 4, and then one part of the drilling fluid enters the third drilling fluid flow passage 51 of the pilot bit 5 via the second drilling fluid flow passage 43 of the transmission mechanism 4 and is eventually jetted from the pilot bit nozzle 53; an other part of the drilling fluid passes through the drilling fluid flow-through hole 47 of the shunting element 42 and the rectifying cavity 46 to enter the nozzle flow passage 223 of the remaining bit, and is eventually jetted from the reaming bit nozzle 224. In the above process, due to the cooperation between the impeller 131 and the throttling disk 141, the drilling fluid periodically passes through the intermittent flow-through holes 1411 of the throttling disk, thereby forming a pulsed jet respectively at the pilot bit nozzle 53 and the reaming bit nozzle 224. In addition, during this process, periodical axial downward impact is generated by periodical change of the amount of the drilling fluid in the pulsating impact generating mechanism 1, so as to periodically apply impact on the pilot bit 5. Through the above process, automatic and reasonable distribution of the WOB respectively on the reaming bit 2 and the pilot bit 5 is realized and chip hold down effect of the drill bit is reduced, and then the drill bit is protected and the ROP is increased.

The pulsed jet type weight-on-bit self-adjusting drill bit shown in FIG. 1 is in a two-stage, further, the pilot bit 5 in FIG. 1 can be replaced with a pulsed jet type weight-on-bit self-adjusting drill bit of a small diameter (two-stage) to form a three-stage pulsed jet type weight-on-bit self-adjusting drill bit; in accordance with the above method, the pilot bit of the three-stage pulsed jet type weight-on-bit self-adjusting drill bit is replaced with a pulsed jet type weight-on-bit self-adjusting drill bit of a smaller diameter (two-stage) to form a four-stage pulsed jet type weight-on-bit self-adjusting drill bit. Thus, a multi-stage pulsed jet type weight-on-bit self-adjusting drill bit can be constructed according to this method.

The above embodiments are used to explain the present application and do not limit the present application, any amendments and changes made to the present application within the protection scope of the present application fall within the protection scope of the present application.

The invention claimed is:

1. A pulsed jet type weight-on-bit self-adjusting drill bit, comprising a reaming bit (2), a weight-on-bit adjusting element (3), a transmission mechanism (4) and a pilot bit (5), the reaming bit (2) comprises a joint (21) and a reaming bit crown (22) connected to the joint (22), the pilot bit (5) is mounted inside the reaming bit crown (22) and protrudes out of the reaming bit crown (22), wherein, a pulsating impact generating mechanism (1) is provided inside the joint (21) for modulating a drilling fluid to form a pulsed jet at a reaming bit nozzle (224) and a pilot bit nozzle (53) respectively and generating a periodic axial downward impulsive force which periodically impacts on the pilot bit (5) during the modulation of the drilling fluid, the pulsating impact generating mechanism (1), the weight-on-bit adjusting element (3), the transmission mechanism (4), and the pilot bit (5) are connected successively;

the pulsating impact generating mechanism (1) comprises a centralizing element (11), a driving element (12), a rotating element (13) and a throttling element (14) which are placed successively, the centralizing element (11), the driving element (12) and the rotating element (13) are connected successively, the throttling element (14) is in clearance fit with the rotating element (13), both of the centralizing element (11) and the throttling element (14) are respectively provided with a flow-through passage for the drilling fluid to flow through, the driving element (12) drives the rotating element (13) to rotate, the rotating element (13) rotates relative to the flow-through passage on the throttling element (14); when the rotating element (13) covers the flow-through passage on the throttling element (14), an amount of the drilling fluid through the flow-through passage on the throttling element (14) is reduced, when the rotating element (13) does not cover the flow-through passage on the throttling element (14), the amount of the drilling fluid through the flow-through passage on the throttling element (14) is increased;

wherein the driving element (12) is a spiral rotor (121), the rotating element (13) is an impeller (131), a part where the spiral rotor (121) is connected to the impeller (131) is a spline type structure (1211), and the spline type structure (1211) cooperates with a key groove (1313) of the impeller (131) so that the impeller (131) is rotated synchronously with the spiral rotor (121); and wherein two ends of the spiral rotor (121) are centralizing shafts, a middle of the spiral rotor (121) is a spiral steel shaft (1214) of single head or multi-head; a first centralizing shaft (1212) is mounted in a middle hole (112) of the centralizing element (11) and protrudes out of the centralizing element (11); a part of a second centralizing shaft (1213) is the spline type structure (1211) and cooperates with the key groove (1313) of the impeller (131), another part of the second centralizing shaft (1213) is a connecting shaft (1215) mounted in the throttling element (14) and protrudes out of the throttling element (14).

2. The pulsed jet type weight-on-bit self-adjusting drill bit according to claim 1, wherein, the throttling element (14), the weight-on-bit adjusting element (3) and a shunting element (42) of the transmission mechanism (4) are placed in an inner cavity formed by connection of the joint (21) and the reaming bit crown (22), the throttling element (14) is in contact with the weight-on-bit adjusting element (3).

3. The pulsed jet type weight-on-bit self-adjusting drill bit according to claim 2, wherein, a first anti-erosion cap (15) is mounted at a part where the first centralizing shaft (1212) protrudes out of the centralizing element (11), and a second anti-erosion cap (16) is mounted at a part where the second centralizing shaft (1213) protrudes out of the throttling element (14).

4. The pulsed jet type weight-on-bit self-adjusting drill bit according to claim 3, wherein, the impeller (131) comprises impeller blades (1311), an impeller center hole (1312) for passing through the second centralizing shaft (1213) is provided in a center of the impeller blades (1311), a side wall of the impeller center hole (1312) is provided with the key groove (1313) of the impeller (131) for transmitting torque in cooperation with the spline type structure (1211) of the second centralizing shaft (1213).

5. The pulsed jet type weight-on-bit self-adjusting drill bit according to claim 4, wherein, the impeller blades (1311) are uniformly distributed in a circumferential direction, a number of the impeller blades (1311) and a number of flow-through passages on the throttling element (14) can be adjusted according to drilling engineering requirements.

6. The pulsed jet type weight-on-bit self-adjusting drill bit according to claim 5, wherein, the throttling element (14) is a throttling disk (141), the flow-through passage is an intermittent flow-through hole (1411) of the throttling disk (141), and a plurality of intermittent flow-through holes (1411) are uniformly distributed in a plane space of the throttling disk (141); a locking gear (1413) of the throttling disk is disposed on an outer side of the throttling disk (141), the locking gear (1413) of the throttling disk is placed in a locking groove provided in the inner cavity formed by the connection of the joint (21) and the reaming bit crown (22), and the locking gear (1413) moves in the locking groove; a throttling disk center hole (1412) is provided in a center of the throttling disk (141), the connecting shaft (1215) of the second centralizing shaft (1213) is mounted in the throttling disk center hole (1412), and the throttling disk center hole (1412) and the second centralizing shaft (1213) cooperate with each other in size.

7. The pulsed jet type weight-on-bit self-adjusting drill bit according to claim 2, wherein, the impeller (131) comprises impeller blades (1311), an impeller center hole (1312) for passing through the second centralizing shaft (1213) is provided in a center of the impeller blades (1311), a side wall of the impeller center hole (1312) is provided with the key groove (1313) of the impeller (131) for transmitting torque in cooperation with the spline type structure (1211) of the second centralizing shaft (1213).

8. The pulsed jet type weight-on-bit self-adjusting drill bit according to claim 7, wherein, the impeller blades (1311) are uniformly distributed in a circumferential direction, a number of the impeller blades (1311) and a number of flow-through passages on the throttling element (14) can be adjusted according to drilling engineering requirements.

9. The pulsed jet type weight-on-bit self-adjusting drill bit according to claim 8, wherein, the throttling element (14) is a throttling disk (141), the flow-through passage is an intermittent flow-through hole (1411) of the throttling disk (141), and a plurality of intermittent flow-through holes (1411) are uniformly distributed in a plane space of the throttling disk (141); a locking gear (1413) of the throttling disk is disposed on an outer side of the throttling disk (141), the locking gear (1413) of the throttling disk is placed in a locking groove provided in the inner cavity formed by the connection of the joint (21) and the reaming bit crown (22), and the locking gear (1413) moves in the locking groove; a throttling disk center hole (1412) is provided in a center of the throttling disk (141), the connecting shaft (1215) of the second centralizing shaft (1213) is mounted in the throttling disk center hole (1412), and the throttling disk center hole (1412) and the second centralizing shaft (1213) cooperate with each other in size.

10. The pulsed jet type weight-on-bit self-adjusting drill bit according to claim 1, wherein a first anti-erosion cap (15) is mounted at a part where the first centralizing shaft (1212) protrudes out of the centralizing element (11), and a second anti-erosion cap (16) is mounted at a part where the second centralizing shaft (1213) protrudes out of the throttling element (14).

11. The pulsed jet type weight-on-bit self-adjusting drill bit according to claim 10, wherein, the impeller (131) comprises impeller blades (1311), an impeller center hole (1312) for passing through the second centralizing shaft (1213) is provided in a center of the impeller blades (1311), a side wall of the impeller center hole (1312) is provided with the key groove (1313) of the impeller (131) for transmitting torque in cooperation with the spline type structure (1211) of the second centralizing shaft (1213).

12. The pulsed jet type weight-on-bit self-adjusting drill bit according to claim 11, wherein, the impeller blades (1311) are uniformly distributed in a circumferential direction, a number of the impeller blades (1311) and a number of flow-through passages on the throttling element (14) can be adjusted according to drilling engineering requirements.

13. The pulsed jet type weight-on-bit self-adjusting drill bit according to claim 12, wherein, the throttling element (14) is a throttling disk (141), the flow-through passage is an intermittent flow-through hole (1411) of the throttling disk (141), and a plurality of intermittent flow-through holes (1411) are uniformly distributed in a plane space of the throttling disk (141); a locking gear (1413) of the throttling disk is disposed on an outer side of the throttling disk (141), the locking gear (1413) of the throttling disk is placed in a locking groove provided in the inner cavity formed by the connection of the joint (21) and the reaming bit crown (22), and the locking gear (1413) moves in the locking groove; a throttling disk center hole (1412) is provided in a center of the throttling disk (141), the connecting shaft (1215) of the second centralizing shaft (1213) is mounted in the throttling disk center hole (1412), and the throttling disk center hole (1412) and the second centralizing shaft (1213) cooperate with each other in size.

14. The pulsed jet type weight-on-bit self-adjusting drill bit according to claim 1, wherein, the impeller (131) comprises impeller blades (1311), an impeller center hole (1312) for passing through the second centralizing shaft (1213) is provided in a center of the impeller blades (1311), a side wall of the impeller center hole (1312) is provided with the key groove (1313) of the impeller (131) for transmitting torque in cooperation with the spline type structure (1211) of the second centralizing shaft (1213).

15. The pulsed jet type weight-on-bit self-adjusting drill bit according to claim 14, wherein, the impeller blades (1311) are uniformly distributed in a circumferential direction, a number of the impeller blades (1311) and a number of flow-through passages on the throttling element (14) can be adjusted according to drilling engineering requirements.

16. The pulsed jet type weight-on-bit self-adjusting drill bit according to claim 15, wherein, the throttling element (14) is a throttling disk (141), the flow-through passage is an intermittent flow-through hole (1411) of the throttling disk (141), and a plurality of intermittent flow-through holes (1411) are uniformly distributed in a plane space of the throttling disk (141); a locking gear (1413) of the throttling disk is disposed on an outer side of the throttling disk (141), the locking gear (1413) of the throttling disk is placed in a locking groove provided in the inner cavity formed by the connection of the joint (21) and the reaming bit crown (22), and the locking gear (1413) moves in the locking groove; a throttling disk center hole (1412) is provided in a center of the throttling disk (141), the connecting shaft (1215) of the second centralizing shaft (1213) is mounted in the throttling disk center hole (1412), and the throttling disk center hole (1412) and the second centralizing shaft (1213) cooperate with each other in size.

* * * * *